US008272706B2

(12) United States Patent
Suzuki

(10) Patent No.: US 8,272,706 B2
(45) Date of Patent: Sep. 25, 2012

(54) LIQUID EJECTING APPARATUS, AND CONTROL METHOD THEREOF, CAPABLE OF CONTROLLING RESIDUAL VIBRATIONS FOLLOWING THE EJECTION OF LIQUID

(75) Inventor: Yoshiyuki Suzuki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 249 days.

(21) Appl. No.: 12/730,149

(22) Filed: Mar. 23, 2010

(65) Prior Publication Data

US 2010/0245425 A1 Sep. 30, 2010

(30) Foreign Application Priority Data

Mar. 24, 2009 (JP) ..... 2009-072227

(51) Int. Cl.
*B41J 29/38* (2006.01)

(52) U.S. Cl. ..... 347/10; 347/5; 347/9

(58) Field of Classification Search ..... 347/10, 347/11, 68–72

See application file for complete search history.

(56) References Cited

U.S. PATENT DOCUMENTS 5,124,716 A * 6/1992 Roy et al. ..... 347/11
6,149,258 A * 11/2000 Kimura ..... 347/10
6,257,688 B1 * 7/2001 Kubo ..... 347/11
6,485,133 B1 11/2002 Teramae et al.

FOREIGN PATENT DOCUMENTS

JP 2003-011352 A 1/2003
JP 2003-094656 A 4/2003

* cited by examiner

*Primary Examiner* — Juanita D Jackson
(74) *Attorney, Agent, or Firm* — Kilpatrick Townsend & Stockton LLP

(57) ABSTRACT

A driving signal includes an ejection driving pulse having an expansion element and a constriction element, and a non-ejection driving pulse having an expansion element and a holding element and a constriction element. The length of time from the end of the constriction element in the ejection driving pulse to the beginning of the expansion element in the non-ejection driving pulse is taken as t; the lengths of time of the expansion element, holding element, and constriction element in the non-ejection driving pulse are taken as a, b, and c, respectively; and the inherent vibration cycle of the liquid within the pressurizing chamber is taken as Tc. t, a, b, and c are within the ranges defined by the following equations:

$$Tc/4 \leqq t \leqq Tc/2 \quad (1)$$

$$(5Tc/8)-t \leqq a \leqq (3\,Tc/4)-t \quad (2)$$

$$b+c=Tc-t-a \quad (3).$$

3 Claims, 5 Drawing Sheets

FIG. 4

Tc=7.5

| t | Iw CHANGE | TAIL-DOCKING EFFECT |
|---|---|---|
| 1.7 | × | ○ |
| 1.8 | △ | ○ |
| 1.9 | ○ | ○ |
| 3.7 | ○ | ○ |
| 3.8 | △ | △ |
| 3.9 | × | × |

Tc=8.0

| t | Iw CHANGE | TAIL-DOCKING EFFECT |
|---|---|---|
| 1.8 | × | ○ |
| 1.9 | △ | ○ |
| 2.0 | ○ | ○ |
| 4.0 | ○ | ○ |
| 4.1 | △ | △ |
| 4.2 | × | × |

Tc=8.5

| t | Iw CHANGE | TAIL-DOCKING EFFECT |
|---|---|---|
| 1.9 | × | ○ |
| 2.0 | △ | ○ |
| 2.2 | ○ | ○ |
| 4.2 | ○ | ○ |
| 4.4 | △ | △ |
| 4.5 | × | × |

LIQUID EJECTING APPARATUS, AND CONTROL METHOD THEREOF, CAPABLE OF CONTROLLING RESIDUAL VIBRATIONS FOLLOWING THE EJECTION OF LIQUID

BACKGROUND

1. Technical Field

The present invention relates to a liquid ejecting apparatus such as an ink jet printer and a control method thereof, and particularly relates to a liquid ejecting apparatus that includes a liquid ejecting head in which a change in pressure is applied to a pressurizing chamber communicating with a nozzle, thereby causing liquid within the pressurizing chamber to be ejected from the nozzle, and to a control method for the apparatus.

2. Related Art

A liquid ejecting apparatus is an apparatus that includes a liquid ejecting head capable of ejecting a liquid, and that ejects various types of liquid from the liquid ejecting head. An image recording apparatus such as an ink jet printer (called simply a printer hereinafter) that is provided with an ink jet recording head (called simply a recording head hereinafter) as its liquid ejecting head and that records images by causing ink in liquid form to be ejected from a nozzle in the recording head and impact upon a recording medium such as a recording sheet (an impact target) may be given as a representative example of such a liquid ejecting apparatus. Meanwhile, in addition to such image recording apparatuses, liquid ejecting apparatuses are recently being applied in various manufacturing apparatuses, such as apparatuses for manufacturing color filters for liquid crystal displays and the like.

Some such liquid ejecting apparatuses are configured so that a change in pressure is applied to the liquid within the pressurizing chamber by applying a driving pulse (ejecting pulse) to a pressurizing element (for example, a piezoelectric vibrator, a heating element, or the like) and driving the element, using this change in pressure to cause liquid to be ejected from the nozzle that communicates with the pressurizing chamber. With such a liquid ejecting apparatus, the amount of ejected liquid may be increased by increasing the amplitude of the pressure oscillation applied to the liquid in the pressurizing chamber. To rephrase, the amount of ejected liquid may be increased by increasing the voltage of an ejection driving pulse (see, for example, JP-A-2003-94656).

Recently, attempts are being made to use such liquid ejecting apparatuses to eject liquids of a higher viscosity (called highly-viscous liquids hereinafter) than liquids handled in the past, such as, for example, UV ink (ultraviolet light-curable ink). In other words, although liquids having a low viscosity similar to water have been handled in the past, attempts are recently being made to eject highly-viscous liquids of 8 millipascals per second or more. In order to obtain a sufficient ejection amount when ejecting such highly-viscous liquids, it is necessary to apply, to the liquid within the pressurizing chamber, a pressure change adapted to the ejection amount. However, increasing the pressure change causes the liquid to travel at a higher speed, which tends to cause the occurrence of a phenomenon in which the posterior portion of the liquid extends in a tail-like form. Thus there has been a risk of this tail-like portion separating and jumping away from the primary droplet and failing to impact in the proper location (the desired location) on the impact target. For example, in ink jet printers, there has been a problem in that the tail-like portion has turned to mist, shifting from the proper location and then impacting, resulting in separated dots and thus leading to a degradation in image quality. In particular, with highly-viscous liquids, the tail-like portion separates into several parts, and those multiple separated parts (satellite ink droplets, or mist) have been the cause of a dramatic drop in image quality.

Therefore, a configuration has been proposed whereby a driving signal is provided with a driving pulse for reducing the aforementioned tail-like portion by quickly retracting the meniscus into the pressurizing chamber immediately after ink has been ejected. This driving pulse is, for example, a non-ejection driving pulse starting with a retracting element that retracts the meniscus by expanding the pressurizing chamber to a degree whereby ink is not discharged from the nozzle.

However, there is a risk that residual vibrations occurring in the ink within the pressurizing chamber due to the application of the non-ejection driving pulse to the pressurizing element will negatively influence the ejecting operations in the next ejection cycle (that is, cause changes in the ink amount, flight speed, and so on). Accordingly, it has been necessary to provide a period for dampening residual vibrations after the non-ejection driving pulse in order to suppress such negative influence. There has thus been a problem that the overall ejection cycle has been lengthened by the vibration dampening period, resulting in a drop in the drive frequency.

SUMMARY

It is an advantage of some aspects of the invention to provide a liquid ejecting apparatus capable of ejecting a highly-viscous liquid in a stable manner by controlling residual vibrations following the ejection of the liquid, and a control method for a liquid ejecting apparatus.

A liquid ejecting apparatus according to an aspect of the invention includes a liquid ejecting head having a nozzle, a pressurizing chamber that communicates with the nozzle, and a pressurizing element that causes a pressure change in liquid within the pressurizing chamber, the liquid ejecting head being capable of ejecting liquid from the nozzle by operating the pressurizing element; and a driving signal generation unit that generates a driving signal including a driving pulse that drives the pressurizing element. The driving signal includes an ejection driving pulse that ejects a liquid droplet and a non-ejection driving pulse that drives the pressurizing element to a degree whereby a liquid droplet is not ejected; the ejection driving pulse is a pulse waveform having an expansion element that causes the pressurizing chamber to expand and retract a meniscus toward the pressurizing chamber and a constriction element that causes the pressurizing chamber expanded by the expansion element to constrict and push the meniscus in the direction of ejection; the non-ejection driving pulse is a pulse waveform having an expansion element that causes the pressurizing chamber to expand and retract the meniscus toward the pressurizing chamber, a holding element that holds the voltage at the end of the expansion element for a set amount of time, and a constriction element that causes the pressurizing chamber expanded by the expansion element to constrict and push the meniscus in the direction of ejection; and when the length of time from the end of the constriction element in the ejection driving pulse to the beginning of the expansion element in the non-ejection driving pulse is taken as t, the lengths of time of the expansion element, holding element, and constriction element in the non-ejection driving pulse are taken as a, b, and c, respectively, and the inherent vibration cycle of the liquid within the pressurizing chamber is taken as Tc, t, a, b, and c are within the ranges defined by the following equations (1) through (3):

$$Tc/4 \leqq t \leqq Tc/2 \quad (1)$$

$$(5Tc/8)-t \leqq a \leqq (3Tc/4)-t \quad (2)$$

$$b+c=Tc-t-a \quad (3)$$

According to this aspect, vibrations of a phase inverted relative to residual vibrations arising in the liquid within the pressurizing chamber due to the ejection of the liquid may be imparted, thereby retracting the meniscus toward the pressurizing chamber and suppressing the growth of tails accompanying the liquid ejected by the ejection driving pulse. Accordingly, the phenomenon in which tails extend from the posterior portion of ejected liquid may be suppressed when ejecting a liquid of a comparatively high viscosity (a highly-viscous liquid). This makes it possible to prevent the liquid from separating into multiple parts and impacting upon the impact target, or in other words, makes it possible to prevent dot separation. Furthermore, because the residual vibrations are suppressed, the residual vibrations may also be suppressed from imparting negative influence on the ejection operations of the next ejection cycle (changes in the ink amount, flight speed, and so on). Further still, because it is unnecessary to provide a vibration dampening period for dampening the residual vibrations following the non-ejection driving pulse, the ejection cycle may be shortened by that amount, thereby making it possible to suppress a drop in the driving frequency.

In the aforementioned aspect of the invention, it is desirable for the voltage difference of the expansion element in the non-ejection driving pulse to be set at less than or equal to 40% of the potential difference between the minimum potential and the maximum potential of the ejection driving pulse.

According to this configuration, the voltage difference of the expansion element in the non-ejection driving pulse is set at less than or equal to 40% of the potential difference between the minimum potential and the maximum potential of the ejection driving pulse, and thus it is possible to suppress an increase in the residual vibrations caused by the expansion element in the non-ejection driving pulse, thereby making it possible to ensure the stability of the meniscus.

A control method according to another aspect of the invention is a control method for a liquid ejecting apparatus that includes a liquid ejecting head having a nozzle, a pressurizing chamber that communicates with the nozzle, and a pressurizing element that causes a pressure change in liquid within the pressurizing chamber, the liquid ejecting head being capable of ejecting liquid from the nozzle by operating the pressurizing element, and a driving signal generation unit that generates a driving signal including a driving pulse that drives the pressurizing element, the method including an ejection driving process of ejecting a liquid droplet and a non-ejection driving process of driving the pressurizing element to a degree whereby a liquid droplet is not ejected. The ejection driving process includes an expansion process of causing the pressurizing chamber to expand and retract a meniscus toward the pressurizing chamber and a constriction process of causing the pressurizing chamber to constrict and push the meniscus in the direction of ejection; the non-ejection driving process includes an expansion process of causing the pressurizing chamber to expand and retract the meniscus toward the pressurizing chamber, an expansion holding process of holding the state of expansion of the pressurizing chamber in the expansion process for a set amount of time, and a constriction process of causing the pressurizing chamber to constrict and push the meniscus in the direction of ejection; and when the length of time from the end of the constriction process in the ejection driving process to the beginning of the expansion process in the non-ejection driving process is taken as t, the lengths of time of the expansion process, holding process, and constriction process in the non-ejection driving pulse are taken as a, b, and c, respectively, and the inherent vibration cycle of the liquid within the pressurizing chamber is taken as Tc, t, a, b, and c are within the ranges defined by the following equations (1) through (3):

$$Tc/4 \leqq t \leqq Tc/2 \quad (1)$$

$$(5Tc/8)-t \leqq a \leqq (3Tc/4)-t \quad (2)$$

$$b+c=Tc-t-a \quad (3)$$

BRIEF DESCRIPTION OF THE DRAWINGS

The invention will be described with reference to the accompanying drawings, wherein like numbers reference like elements.

FIG. 3A is a waveform diagram illustrating the configuration of a driving pulse, whereas

FIG. 4 is a chart illustrating results of an experiment observing the stability of ink droplet ejection.

DESCRIPTION OF EXEMPLARY EMBODIMENTS

Hereinafter, embodiments of the invention will be described with reference to the appended drawings. Although various limitations are made in the embodiments described hereinafter in order to illustrate a specific preferred example of the invention, it should be noted that the scope of the invention is not intended to be limited to these embodiments unless such limitations are explicitly mentioned hereinafter. An ink jet recording apparatus (referred to as a printer) will be given hereinafter as an example of a liquid ejecting apparatus according to the invention.

Figure 1:
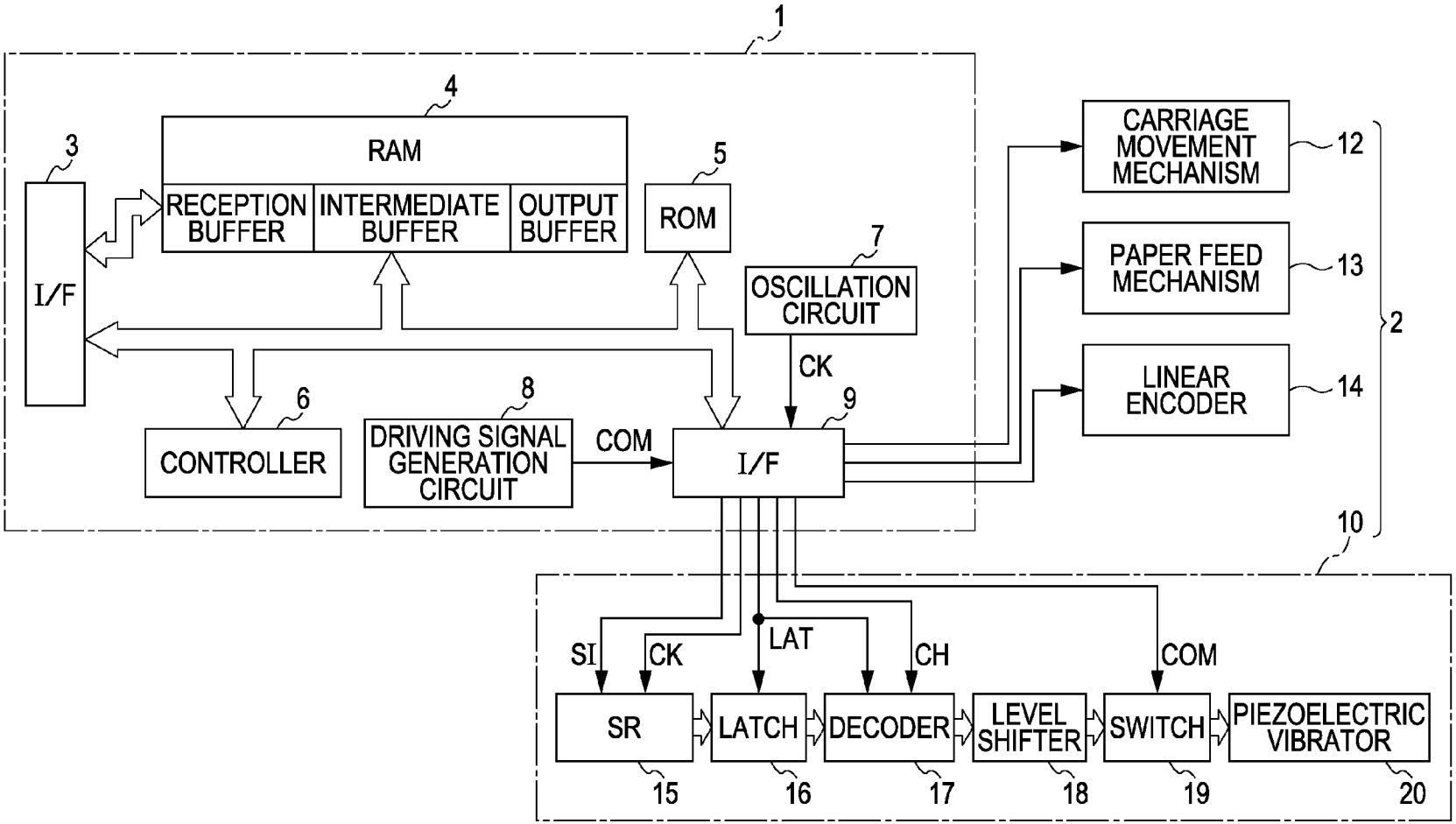
FIG. 1 is a block diagram illustrating the electrical configuration of a printer.

FIG. 1 is a block diagram illustrating the electrical configuration of a printer. This printer is broadly configured of a printer controller 1 and a print engine 2. The printer controller 1 includes an external interface (external I/F) 3 that exchanges data with an external device such as a host computer or the like, a RAM 4 that stores various data and the like, a ROM 5 that stores control routines and the like for various data processes, a controller 6 that controls the various elements, an oscillation circuit 7 that generates a clock signal, a driving signal generation circuit 8 that generates a driving signal to be supplied to a recording head 10, and an internal interface (internal I/F) 9 for outputting dot pattern data, driving signals, and so on to the recording head 10.

In addition to controlling the various elements, the controller 6 converts print data received from an external device via the external I/F 3 into dot pattern data and outputs this dot pattern data to the recording head 10 via the internal I/F 9. This dot pattern data is configured of printing data obtained by decoding (translating) gradation data. In addition, the controller 6 supplies a latch signal, channel signal, and so on to the recording head 10 based on the clock signal from the oscillation circuit 7. The latch and channel pulses within the latch and channel signals, respectively, define the supply timings of the various pulses that configure the driving signal.

The driving signal generation circuit 8 generates a driving signal for driving a piezoelectric vibrator 20 under the control of the controller 6. The driving signal generation circuit 8 according to this embodiment is configured so as to generate a driving signal COM that includes, within a single recording cycle, an ejection driving pulse for ejecting an ink droplet (an example of a liquid droplet) and forming a dot upon the recording sheet (an example of an impact target), a micro-vibration pulse for agitating ink (an example of a liquid) by causing micro-vibrations in the free surface of the ink, or in other words, in the meniscus, and so on exposed through a nozzle 32 (see FIG. 2).

The configuration of the print engine 2 will be described next. The print engine 2 is configured of the recording head 10, a carriage movement mechanism 12, a paper feed mechanism 13, and a linear encoder 14. The recording head 10 includes a shift register (SR) 15, a latch 16, a decoder 17, a level shifter 18, a switch 19, and a piezoelectric vibrator 20. Dot pattern data (SI) from the printer controller 1 undergoes serial transmission to the shift register 15 in synchronization with the clock signal (CK) from the oscillation circuit 7. This dot pattern data is 2-bit data, and is configured of gradation information expressing, for example, four levels of recording gradations (ejection gradations) including non-recording (micro-vibration), small dot, medium dot, or large dot. To be more specific, non-recording is expressed by gradation information "00", a small dot is expressed by gradation information "01", a medium dot is expressed by gradation information "10", and a large dot is expressed by gradation information "11".

The latch 16 is electrically connected to the shift register 15, and when a latch signal (LAT) is inputted into the latch 16 from the printer controller 1, the dot pattern data in the shift register 15 is latched. The dot pattern data latched in the latch 16 is inputted into the decoder 17. The decoder 17 translates the 2-bit dot pattern data and generates pulse selection data. The pulse selection data is configured by associating the pulses of which the driving signal COM is configured with respective bits. Then, whether to supply or not supply an ejection driving pulse to the piezoelectric vibrator 20 is selected based on the content of each bit, which is, for example, "0", "1", or the like.

The decoder 17 then outputs the pulse selection data to the level shifter 18 upon receiving the latch signal (LAT) or the channel signal (CH). In this case, the pulse selection data is inputted into the level shifter 18 starting with the most significant bit. The level shifter 18 functions as a voltage amplifier, and outputs, if the pulse selection data is "1", an electric signal capable of driving the switch 19, or in other words, whose voltage has been boosted, for example, by approximately several tens of volts. The pulse selection data "1" boosted by the level shifter 18 is supplied to the switch 19. The driving signal COM from the driving signal generation circuit 8 is supplied to the input of the switch 19, and the piezoelectric vibrator 20 is connected to the output of the switch 19.

The pulse selection data controls the operation of the switch 19, or in other words, controls the supply of the driving pulse within the driving signal to the piezoelectric vibrator 20. For example, during the period where the pulse selection data inputted into the switch 19 is "1", the switch 19 enters a connected state, and the corresponding ejection driving pulse is supplied to the piezoelectric vibrator 20; the potential level of the piezoelectric vibrator 20 changes in accordance with the waveform of the ejection driving pulse. Meanwhile, during the period where the pulse selection data is "0", no electric signal causing the switch 19 to operate is outputted from the level shifter 18. Accordingly, the switch 19 enters a disconnected state, and the ejection pulse is not supplied to the piezoelectric vibrator 20.

The decoder 17, level shifter 18, switch 19, controller 6, and driving signal generation circuit 8 operating in this manner function as an ejection control unit, selecting a necessary ejection driving pulse from the driving signal based on the dot pattern data and applying (supplying) the pulse to the piezoelectric vibrator 20. As a result, the piezoelectric vibrator 20 extends or retracts, and a pressurizing chamber 35 (see FIG. 2) expands or constricts in accordance with the extension/retraction of the piezoelectric vibrator 20, causing an amount of ink droplet corresponding to the gradation information of which the dot pattern data is configured to be ejected from the nozzle 32.

Figure 2:
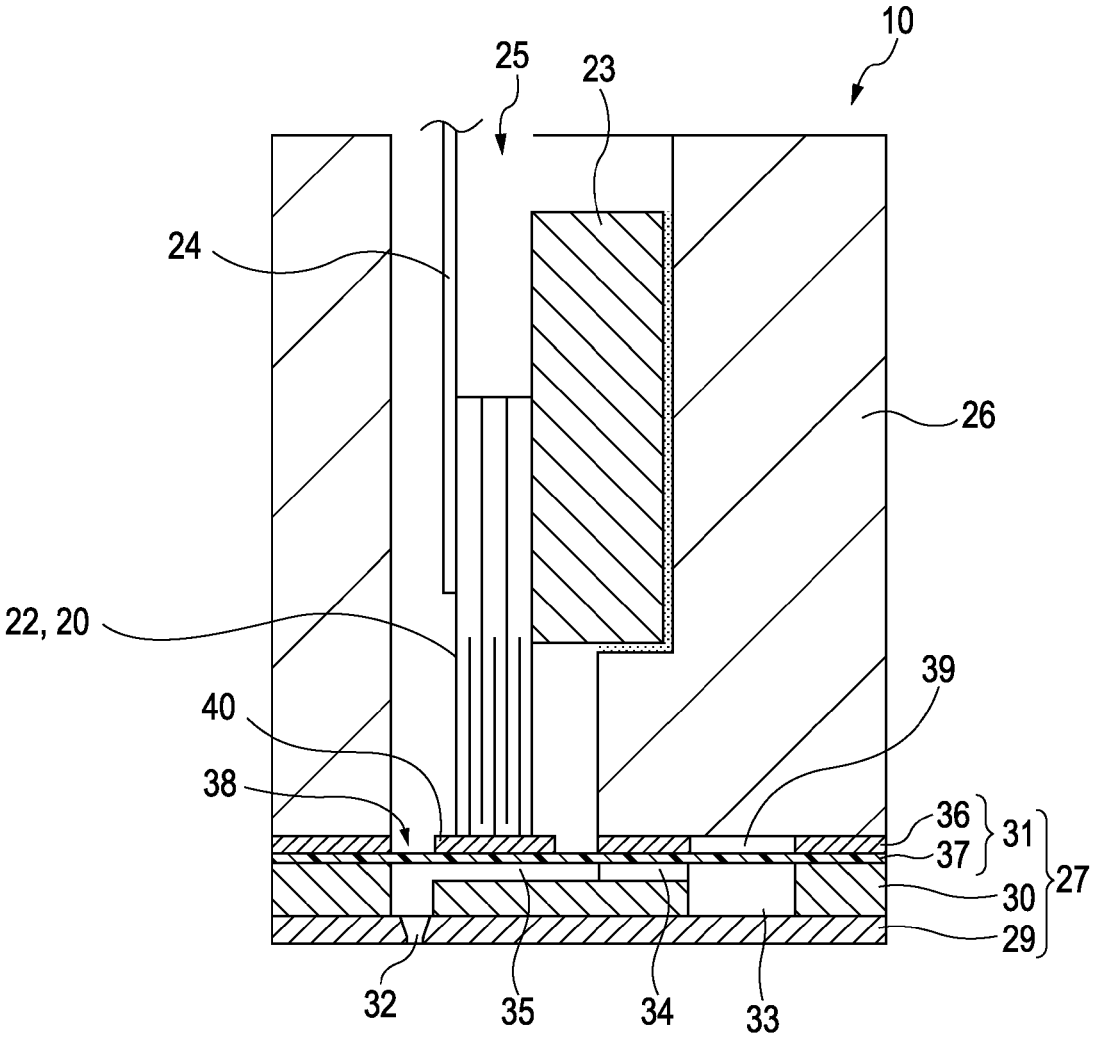
FIG. 2 is a cross-section illustrating the principal constituent elements of a recording head.

FIG. 2 is a cross-section illustrating the principal constituent elements of the recording head 10 (an example of a liquid ejecting head according to the invention). The recording head 10 according to this embodiment is configured so as to include: a vibrator unit 25 in which a piezoelectric vibrator group 22, an anchor plate 23, a flexible cable 24, and so on are consolidated as a single unit; a head case 26 capable of housing the vibrator unit 25; and a flow channel unit 27 forming a serial ink flow channel (liquid flow channel) extending from a reservoir 33 serving as a common ink chamber (common liquid chamber), through the pressurizing chamber 35, and to the nozzle 32.

First, the vibrator unit 25 will be described. The piezoelectric vibrators 20 (an example of a pressurizing element according to the invention) of which the piezoelectric vibrator group 22 is configured have a tall, thin pectinate form, and are split into extremely thin widths of approximately several tens of μm. The piezoelectric vibrators 20 are configured as vertically-vibrating piezoelectric elements capable of extending and retracting in the vertical direction. Each piezoelectric vibrator 20 has its anchor end joined to the anchor plate 23, with its free end projecting further than the end edge of the anchor plate 23, and is thus anchored in a so-called cantilever state. The tip of the free end in each piezoelectric vibrator 20 is, as will be described later, joined to an insular portion 40 of which a diaphragm portion 38 in the flow channel unit 27 is configured. The flexible cable 24 is electrically connected to the piezoelectric vibrator 20 on the side of the anchored end opposite to the anchor plate 23. The anchor plate 23 that supports each piezoelectric element 20, meanwhile, is configured of a metallic plate rigid enough to arrest the reactive force from the piezoelectric vibrator 20.

Next, the flow channel unit 27 will be described. The flow channel unit 27 is configured of a nozzle plate 29, a flow channel formation plate 30, and a vibrating plate 31; these plates are layered with the nozzle plate 29 disposed on one surface of the flow channel formation plate 30 and the vibrating plate 31 disposed on the other surface of the flow channel formation plate 30, or in other words, on the side opposite the nozzle plate 29, and are configured as a single entity through bonding or the like. The nozzle plate 29 is a thin stainless-steel plate in which multiple nozzles 32 are provided in a row at a pitch corresponding to the dot formation density. In this embodiment, for example, 180 nozzles 32 are provided in a row, and a nozzle row (nozzle group) is thus formed by these nozzles 32. Furthermore, two of these nozzle rows are provided side by side.

The flow channel formation plate 30 is a plate-shaped member, configured of the reservoir 33, an ink supply opening 34, and a pressurizing chamber 35, that forms a serial ink flow channel (an example of a liquid flow channel). To be more specific, the flow channel formation plate 30 is a plate-shaped member in which multiple cavities serving as pressurizing chambers 35 are formed by wall divisions so as to correspond to respective nozzles 32, and in which cavities serving as the ink supply opening 34 and the reservoir 33 are formed. The flow channel formation plate 30 according to this embodiment is manufactured by etching a silicon wafer. The aforementioned pressurizing chambers 35 are formed as long, thin chambers extending perpendicularly relative to the direction of the row of nozzles 32 (the nozzle row direction), and the ink supply opening 34 is formed as an artery, having a narrow flow width, that communicates between the pressurizing chambers 35 and the reservoir 33. Meanwhile, the reservoir 33 is a chamber for supplying ink held in an ink cartridge (not shown) to the pressurizing chambers 35, and communicates with corresponding pressurizing chambers 35 via the ink supply opening 34.

The vibrating plate 31 is a compound plate having a dual-layer construction in which a resin film 37 such as PPS (polyphenylene sulfide) has been laminated upon a metallic support plate 36 configured of stainless steel or the like, and is a member that has a diaphragm portion 38, sealing one of the open sides of the pressurizing chamber 35, for varying the capacity of the pressurizing chamber 35, and a compliance portion 39 that seals one of the open sides of the reservoir 33. The diaphragm portion 38 is configured by etching the support plate 36 in a location corresponding to the pressurizing chamber 35 so as to remove a ring-shaped portion from that location, thereby forming the insular portion 40 to be joined with the free end of the piezoelectric vibrator 20. Similar to the planar shape of the pressurizing chamber 35, the insular portion 40 has a long, thin block shape extending perpendicularly relative to the direction of the row of nozzles 32, and the resin film 37 surrounding the insular portion 40 functions as an elastic membrane. Meanwhile, the portion functioning as the compliance portion 39, or in other words, the portion corresponding to the reservoir 33, is configured only of the resin film 37, with the support plate 36 having been completely removed through etching based on the shape of the opening of the reservoir 33.

With the recording head 10 configured as described above, causing the piezoelectric vibrator 22 to distort causes the corresponding pressurizing chamber 35 to constrict or expand, thereby causing a change in the pressure of the ink within the pressurizing chamber 35. Controlling this ink pressure makes it possible to eject ink (ink droplets) from the nozzle 32. If the pressurizing chamber 35 of a standard capacity is preliminarily expanded prior to the ejection of ink, ink is supplied to the pressurizing chamber 35 from the reservoir 33 via the ink supply opening 34. If the pressurizing chamber 35 is then caused to suddenly constrict after the preliminary expansion, ink is ejected from the nozzle 32.

Figure 3A:
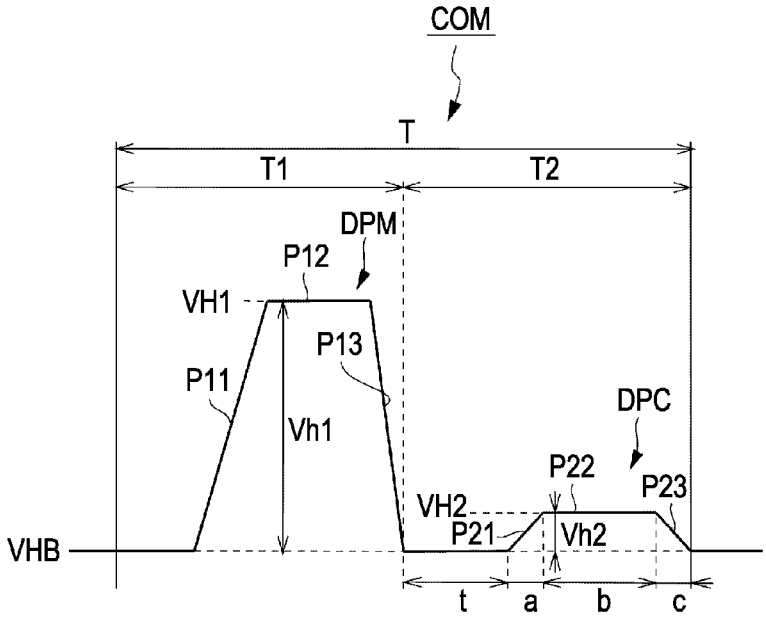

Next, the various driving pulses within the driving signal COM generated by the driving signal generation circuit 8 will be described. As shown in FIG. 3A, the driving signal COM according to this embodiment is a serial signal having, within a unit recording cycle (ejection cycle) T, a middle dot ejection driving pulse DPM (an example of an ejection driving pulse according to the embodiment) and a cut driving pulse DPC for retracting the meniscus of the nozzle following ink ejection and thereby suppressing the occurrence of tails in the ink (corresponding to a non-ejection driving pulse according to the embodiment), and is repeatedly emitted every recording cycle T. In this embodiment, a single recording cycle T of the driving signal COM is divided into two pulse emission intervals, or T1 and T2. In the interval T1, a first middle dot ejection driving pulse DPM is emitted, whereas in the interval T2, the cut driving pulse DPC is emitted.

First, the middle dot ejection driving pulse DPM of the driving signal COM, emitted during the interval T1, will be described. As shown in FIG. 3A, the middle dot ejection driving pulse DPM is a middle dot ejection driving pulse for ejecting an ink droplet of a size that is between the sizes of the smallest ink droplet and the largest ink droplet that may be ejected by the printer according to this embodiment (that is, a middle dot). This middle dot ejection driving pulse DPM includes a first expansion element P11 (corresponding to an expansion element according to the invention), a first expansion hold element P12 (an expansion holding element), and a first constriction element P13 (corresponding to an ejection element according to the invention). The first expansion element P11 is a waveform element in which the potential is caused to rise from a base potential VHB to a first expansion potential VH1 in a comparatively gradual constant slope that does not cause ink to be ejected, whereas the first expansion hold element P12 is a waveform element where the first expansion potential VH1 is held constant. The first constriction element P13, meanwhile, is a waveform element that causes the potential to drop from the first expansion potential VH1 to the base potential VHB with a sudden slope.

The cut driving pulse DPC in the driving signal COM, emitted in the interval T2 (the final interval in the recording cycle T), includes a second expansion element P21 (corresponding to an expansion element according to the invention), a second expansion hold element P22 (corresponding to a hold element according to the invention), and a second constriction element P23 (corresponding to a constriction element according to the invention). The second expansion element P21 is a waveform element in which the potential is caused to rise from the base potential VHB to a second expansion potential VH2 in a comparatively gradual constant slope that does not cause ink to be ejected, whereas the second expansion hold element P22 is a waveform element where the second expansion potential VH2 is held constant. The second constriction element P23, meanwhile, is a waveform element that causes the potential to drop from the second expansion potential VH2 to the base potential VHB with a gradual, constant slope. Note that the relationship between the sizes of a potential difference Vh1 between the base potential VHB and the first expansion potential VH1 and a potential difference Vh2 between the base potential VHB and the second expansion potential VH2 is Vh1>Vh2. In other words, the relationship between a maximum expansion capacity Cmx (C1) and a second expansion capacity C2 is Cmx(C1)>C2. In addition, the base potential VHB may employ the value from the second expansion potential VH2 to the first expansion potential VH1.

Figure 3B:
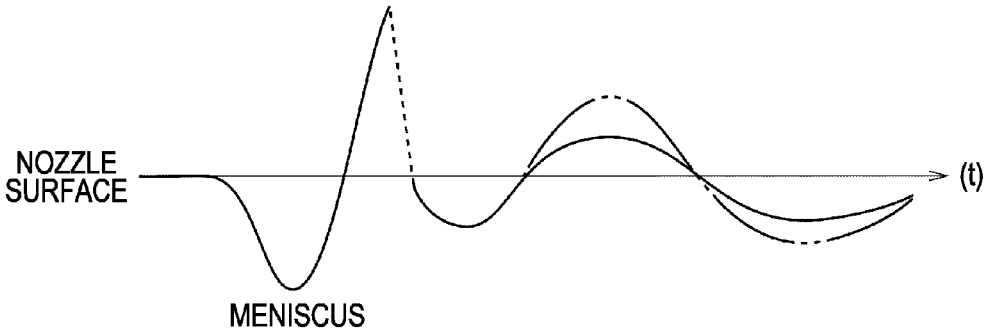
FIG. 3B is a schematic diagram illustrating a change in the leading edge speed of a meniscus caused by the driving pulse shown in FIG. 3A.

Next, the recording of a middle dot under the aforementioned configuration will be described. In this case, the middle dot ejection driving pulse DPM is applied to the piezoelectric vibrator 20 during the interval T1, whereas the cut driving pulse DPC is applied to the piezoelectric vibrator 20 during the interval T2. When the middle dot ejection driving pulse DPM configured in this manner is supplied to the piezoelectric vibrator 20, first, the piezoelectric vibrator 20 retracts in the vertical direction due to the first expansion element P11, and the pressurizing chamber 35 expands from a base capacity corresponding to the base potential VHB to an expanded capacity corresponding to the first expansion potential VH1 (an expansion process). As shown in FIG. 3B, as a result of this expansion, the meniscus is significantly retracted toward the pressurizing chamber 35, and ink is supplied to the pressurizing chamber 35 from the reservoir 33 via the ink supply opening 34. This expanded state of the pressurizing chamber 35 is maintained during the interval in which the first expansion hold element P12 is supplied. During this time, the direction in which the central portion of the meniscus moves reverses to the ejection direction, and the central portion of the meniscus, which is easily affected by changes in pressure, is pushed out in the ejection direction, rising in a column shape (this portion is called a liquid column portion hereinafter). After this, the first constriction element P13 is supplied, extending the piezoelectric vibrator 20. The pressurizing chamber 35 suddenly constricts from the expanded capacity to the base capacity corresponding to the base potential VHB due to the extension of the piezoelectric vibrator 20 (a constricting process). The constriction of the pressurizing chamber 35 pressurizes the ink within the pressurizing chamber 35, and as a result, the liquid column portion continues to move in the ejection direction due to the inertia force arising when pushed in the ejection direction during the pressurizing chamber constricting process; the liquid column portion extends further in the ejection direction during this time. The base of the liquid column portion (on the side of the pressurizing chamber) remains connected to the meniscus as a liquid column portion grows, whereas the tip of the liquid column portion (on the ejection side) travels forcefully from the nozzle 32 towards the recording sheet as an ink droplet containing an amount of ink corresponding to the middle dot, pulling a tail therebehind (an ejection driving process). Note that at this time, the tip of the liquid column portion is shaped as a droplet whose tail is connected to the meniscus (the base) within the nozzle 32; the cut driving pulse DPC, which actively splits this tail portion and stabilizes the meniscus, will be described hereinafter.

When the cut driving pulse DPC is applied to the piezoelectric vibrator 20 in a state where the tip and base of the liquid column portion are connected, first, the piezoelectric vibrator 20 retracts in the vertical direction due to the second expansion element P21, and the pressurizing chamber 35 expands from the base capacity corresponding to the base potential VHB to an expanded capacity corresponding to the second expansion potential VH2 (an expansion process). The meniscus is once again retracted toward the pressurizing chamber 35 as a result of this expansion, and in particular, the periphery of the liquid column portion in the meniscus is retracted toward the pressurizing chamber 35. As a result, the liquid column portion is split into a thin tail end connected to the tip and an apical portion connected to the meniscus. The tip that has separated from the meniscus forms a streamlined ink droplet (the aforementioned middle dot) and travels toward the recording sheet. This expanded state of the pressurizing chamber 35 is maintained during the interval in which the second expansion hold element P22 is supplied (an expansion holding process). After this, the second constriction element P23 is supplied, extending the piezoelectric vibrator 20. The pressurizing chamber 35 constricts from the expanded capacity to the base capacity corresponding to the base potential VHB due to the extension of the piezoelectric vibrator 20 (a constricting process). Here, the potential difference between the base potential VHB and the second expansion potential VH2, or in other words, the driving voltage of the driving pulse DPC, is set to a value much lower than the driving potential of the middle dot ejection driving pulse DPM. Accordingly, when the cut driving pulse DPC is supplied to the piezoelectric vibrator 20, a pressure oscillation of a size that actively separates the trailing tail portion but does not cause ink to be ejected from the nozzle 32 occurs in the pressurizing chamber 35 (a non-ejecting driving process). As a result, an amount of ink corresponding to a middle dot is ejected once from the nozzle 32 during the recording cycle T; the ink impacts upon the recording sheet in a pixel region, thereby forming a middle dot. After the ink ejection caused by the middle dot ejection driving pulse DPM, the meniscus in the nozzle 32 is quickly retracted toward the pressurizing chamber 35 due to the second expansion element P21 in the cut driving pulse DPC. This reduces the growth of tails (trailing tails) that accompany ink ejected due to the middle dot ejection driving pulse DPM, even if the ink is of a high viscosity.

However, if, in the case where the cut driving pulse DPC is supplied after the ink ejection caused by the middle dot ejection driving pulse DPM, residual vibrations in the meniscus caused by the supply of the middle dot ejection driving pulse DPM synchronize with the vibrations caused by the cut driving pulse DPC, the amplitude of the residual vibrations will be amplified, leading to a risk of unstable ejection, whereby, for example, the ink droplet in the next recording cycle will travel in a curve due to the amplified residual vibrations. With respect to this point, setting the length of time from the end of the constriction element P13 of the ejection driving pulse DPM to the beginning of the expansion element P21 of the cut driving pulse DPC to be longer Obe considered as a way to supply the cut driving pulse DPC after first dampening (restricting), to the greatest extent possible, vibrations in the meniscus arising due to the middle dot ejection driving pulse DPM; however, doing so lengthens the waveform length of the driving pulse as a whole within the unit recording cycle T, leading to a problem in that it is difficult to apply the technique to high-frequency driving.

In light of the above, the printer according to the invention optimizes the waveform elements of the cut driving pulse DPC, thereby suppressing residual vibrations following ink ejection and thus ejecting ink droplets in a stable manner. To be more specific, in order to apply an amplitude (vibration) of a phase inverted relative to the residual vibrations in the meniscus caused by the supply of the ejection driving pulse DPM, the aforementioned driving single COM is set so that the length of time t from the end of the constriction element P13 of the ejection driving pulse DPM to the beginning of the second expansion element P21 of the cut driving pulse DPC and the lengths of time a, b, and c of the second expansion element P21, the hold element P22, and the second constriction element P23, respectively, of the cut driving pulse DPC and the inherent vibration cycle Tc of the ink in the pressurizing chamber, are within the ranges shown in the following Equations (1) through (3). This is shown hereinafter.

$$Tc/4 \leqq t \leqq Tc/2 \tag{1}$$

$$(5Tc/8)-t \leqq a \leqq (3Tc/4)-t \tag{2}$$

$$b+c=Tc-t-a \tag{3}$$

Note that the vibration cycle Tc of the ink within the pressurizing chamber 35 can be expressed by the following equation (A), as disclosed in, for example, Patent Document 2, or JP-A-2003-11352.

$$Tc=2\pi\sqrt{[\{(Mn\times Ms)/(Mn+Ms)\}\times Cc]} \tag{A}$$

Note that in Equation (A), Mn expresses the inertance of the nozzle 32, Ms expresses the inertance of the ink supply opening 34, and Cc expresses the compliance (that is, the degree of capacity change or flexibility per unit of pressure) of the pressurizing chamber 35. In the above Equation (A), the inertances M indicate how easily the ink within the ink flow channel will move, and are ink masses per unit of cross-sectional area. The inertances M may be approximated through the following Equation (B), taking the ink density as p, the cross-sectional area of the surface perpendicular to the direction of the ink flow within the flow channel as S, and the length of the flow channel as L.

$$\text{inertance } M = (\text{density } \rho \times \text{length } L)/\text{cross-sectional area } S \quad \text{(B)}$$

Furthermore, Tc is not limited to the above Equation (A), and may be any vibration cycle of the pressurizing chamber 35.

That is, to put the Equations (1) through (3) in different terms, supplying the cut driving pulse DPC of a phase inverted relative to the residual vibrations in the meniscus arising due to the supply of the ejection driving pulse DPM dampens the residual vibrations in the meniscus, as opposed to when not supplying the cut driving pulse DPC (the double-dot-dash line shown in FIG. 3B). To be more specific, the Equations (1) and (2) cause the second expansion element P21 of the cut driving pulse DPC to be supplied and cause the piezoelectric vibrator 20 to constrict, thereby expanding the pressurizing chamber 35, when the meniscus, which has been pushed toward the ejection side when ink has been ejected due to the ejection driving pulse DPM, retracts toward the pressurizing chamber 35 due to residual vibrations and then moves once again toward the ejection side. This inverts, relative to the residual vibrations, the phase of the change in pressure in the pressurizing chamber 35 caused by the second expansion element P21 of the cut driving pulse DPC. Furthermore, Equation (3) causes the second hold element P22 of the cut driving pulse DPC to be supplied so as to maintain the expanded state of the pressurizing chamber 35, and then causes the piezoelectric vibrator 20 to extend by supplying the second constriction element P23, thereby causing the pressurizing chamber 35 to constrict, when the meniscus retracts toward the pressurizing chamber 35 after ink ejection, moves once again toward the ejection side, and furthermore is retracted back toward the pressurizing chamber 35 due to the residual vibrations. This inverts, relative to the residual vibrations, the phase of the change in pressure in the pressurizing chamber 35 caused by the second hold element P22 and second constriction element P23 of the cut driving pulse DPC. As a result, residual vibrations in the meniscus are dampened in an extremely short amount of time.

Regarding the length of time t from the end of the constriction element P13 of the ejection driving pulse DPM to the beginning of the second expansion element P21 of the cut driving pulse DPC, causing the piezoelectric vibrator 20 to retract by supplying the second expansion element P21 of the cut driving pulse DPC when the post-ink ejection meniscus moves toward the pressurizing chamber 35 increases vibrations in the inherent vibration cycle Tc of the ink within the pressurizing chamber 35, causing unnecessary vibrations in the meniscus. Accordingly, it is necessary to set the length of time t to within a certain range in order to maintain the stability of ink droplet ejection. This range for the length of time t is determined based on the results of an experiment that has actually been carried out.

FIG. 4 is a chart illustrating results of the experiment observing the stability of ink droplet ejection under different lengths of time t. Note that in this experiment, the inherent vibration cycles Tc of the ink within the pressurizing chamber 35 were 7.5 μm, 8.0 μm, and 8.5 μm. With respect to ink droplet ejection stability, the weights of the ink that impacted upon the recording sheet were measured (ink fluctuation), with weights of impacted ink having an error relative to a set weight exceeding a pre-set range (for example, 7 ng) indicated as an X, an error relative to the set weight in a range tolerable for use indicated as a triangle, and an error relative to the set weight within the pre-set range indicated as a circle; meanwhile, the ink droplets actually ejected or the mist ink accompanying the residually-vibrating meniscus following the ejection of ink droplets were observed (a tail docking effect), with the occurrence of mist ink indicated as an X, a reduction of tails trailing from the ink droplets indicated as a triangle, and a favorable stability indicated as a circle.

First, with respect to ink fluctuation, it may be seen that when the inherent vibration cycle Tc of the ink within the pressurizing chamber 35 was set to 7.5 μm, ink might not be ejected in a stable manner unless the length of time t was greater than or equal to 1.9 μs and less than or equal to 3.7 μs, or in other words, was greater than or equal to ¼ the inherent vibration cycle Tc and less than or equal to ½ the inherent vibration cycle Tc. Meanwhile, with respect to the tail docking effect, it may be seen that ejection stability might be achieved if the length of time t was set to less than or equal to 3.7 μs, or in other words, less than or equal to ½ the inherent vibration cycle Tc. Similarly, when the inherent vibration cycle Tc was set to 8.0 μm and 8.5 μm, it may be seen that ejection stability might be achieved with respect to ink fluctuation if the length of time t was set to greater than or equal to ¼ and less than or equal to ½ of the inherent vibration cycle Tc, and might be achieved with respect to the tail docking effect if the length of time t was set to less than or equal to ½ of the inherent vibration cycle Tc.

Based on the above, it was understood that a reduction in trailing tails in ink droplets and favorable ejection stability may be achieved while suppressing the length of time of the overall waveform of the driving pulse per unit recording cycle T by setting the length of time t to greater than or equal to ¼ and less than or equal to ½ the inherent vibration cycle Tc.

Meanwhile, it is preferable to set the length of time a of the second expansion element P21 in the cut driving pulse DPC to be supplied when the meniscus that has been pushed toward the ejection side is retracted back toward the pressurizing chamber 35 due to residual vibrations and then once again moves toward the ejection side and during the period where the meniscus is pushed beyond (in the ejection direction) the surface of the nozzle 32 on the ejection side (the nozzle surface). This inverts, relative to the residual vibrations, the phase of the change in pressure in the pressurizing chamber 35 caused by the second expansion element P21 of the cut driving pulse DPC. Meanwhile, the length of time b of the second hold element P22 and the length of time c of the second constriction element P23 in the cut driving pulse DPC may be set so that the end of the second constriction element P23 corresponds to the end of a single inherent vibration cycle Tc in order to invert, relative to the residual vibrations, the phase of the change in pressure within the pressurizing chamber 35 caused by the second hold element P22 and the second constriction element P23 in the aforementioned cut driving pulse DPC. Accordingly, the total (b+c) of the length of time b of the second hold element P22 and the length of time c of the second constriction element P23 in the cut driving pulse DPC is set to a length of time equivalent to the inherent vibration cycle Tc minus the length of time t and the length of time a. Supplying a cut driving pulse DPC configured in this manner makes it possible to suppress residual vibrations following ink ejection and eject ink droplets in a stable manner.

Furthermore, in this embodiment, the voltage difference Vh2 of the second expansion element P21 in the aforementioned cut driving pulse DPC is set to less than or equal to 40% of the potential difference Vh1 between the minimum voltage VHB and the maximum voltage VH1 of the ejection driving pulse DPM. Increasing the voltage difference Vh2 increases the risk that ink will be ejected due to the cut driving pulse DPC. Accordingly, setting the voltage difference Vh2 in the second expansion element P21 to less than or equal to 40% of the potential difference Vh1 makes it possible to suppress an increase in the residual vibrations caused by the second expansion element P21 of the cut driving pulse DPC, making it possible to ensure the stability of the meniscus.

When ejecting an ink having a higher viscosity than inks in the past (a highly-viscous liquid), such as an ultraviolet light-curable ink that is cured by being irradiated with optical energy such as ultraviolet light, employing the configuration described thus far, or in other words, supplying a cut driving pulse DPC in which the lengths of time t, a, b, and c have been optimized to the piezoelectric vibrator 20 after ink has been ejected by the ejection driving pulse DPM makes it possible to impart vibrations of a phase inverted relative to residual vibrations arising in the ink within the pressurizing chamber 35 due to the ejection of the ink by the ejection driving pulse DPM; therefore, the meniscus is retracted toward the pressurizing chamber 35, and the growth of tails accompanying the ink ejected by the ejection driving pulse DPM is suppressed. Accordingly, the phenomenon in which tails extend from the posterior portion of ejected ink may be suppressed. This makes it possible to prevent ink from separating into multiple parts and impacting upon the recording sheet, or in other words, makes it possible to prevent dot separation. Furthermore, because the residual vibrations are suppressed, the residual vibrations may also be suppressed from imparting negative influence on the ejection operations of the next recording cycle (changes in the ink amount, flight speed, and so on). Further still, because it is unnecessary to provide a vibration dampening period for dampening the residual vibrations following the cut driving pulse DPC, the ejection cycle may be shortened by that amount, thereby making it possible to suppress a drop in the driving frequency.

Note that the invention is not limited to the above-described embodiment, and many variations based on the content of the appended claims are possible.

Figure 5:
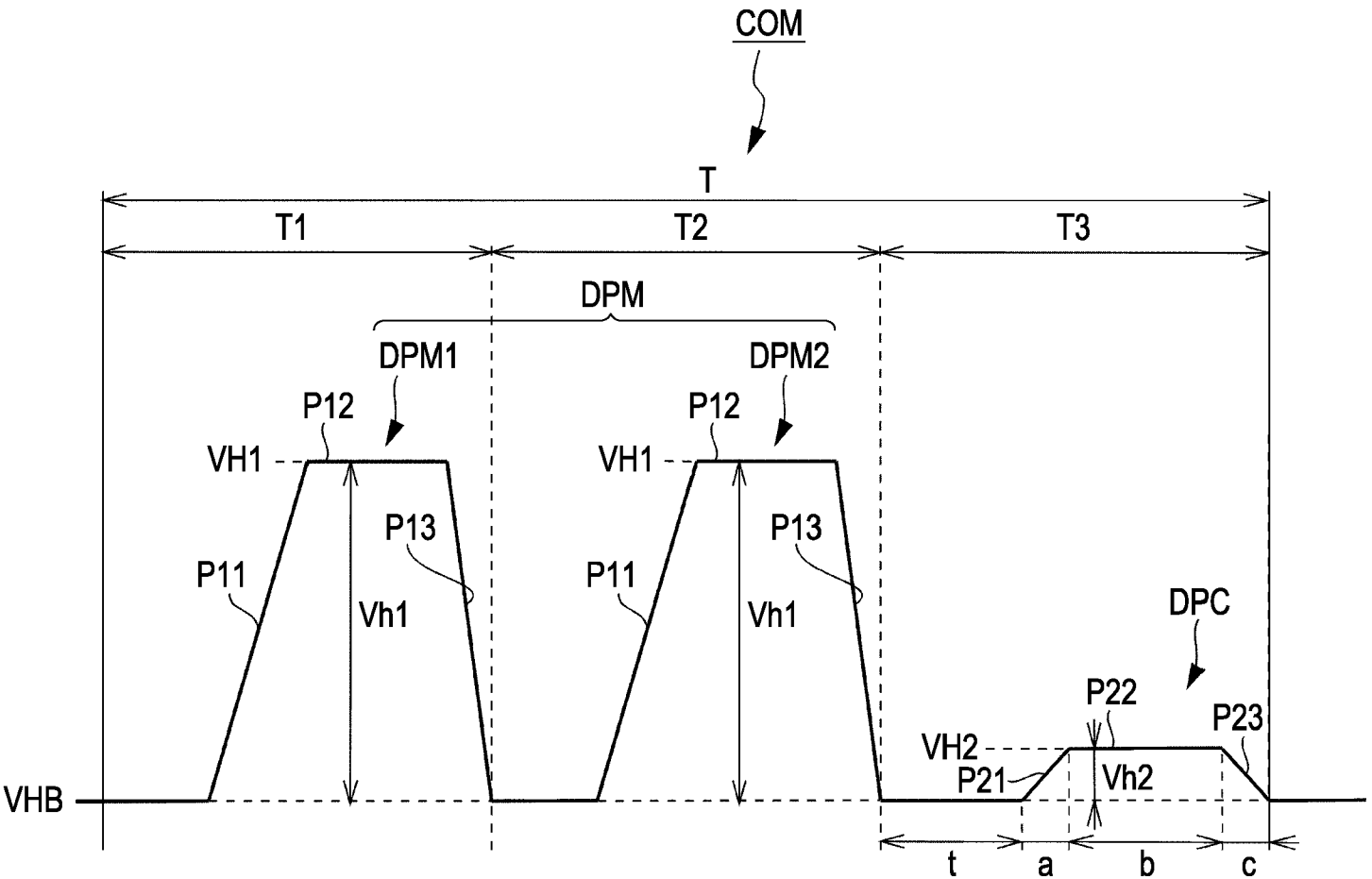
FIG. 5 is a waveform diagram illustrating the configuration of a driving pulse in a second embodiment.

FIG. 5 is a waveform diagram illustrating the configuration of a driving pulse in a second embodiment. In the aforementioned embodiment, a middle dot ejection pulse DPM for recording a middle dot was described as an example of a driving pulse according to the invention, but the form of the driving pulse is not limited thereto. For example, the driving pulse for recording a large dot illustrated in FIG. 5 is a serial signal having, within a unit recording cycle (ejection cycle) T, a middle dot ejection driving pulse DPM (DPM1 and DPM2) and a cut driving pulse DPC, and configured so as to be repeatedly emitted every recording cycle T. In this embodiment, a single recording cycle T of the driving signal COM is divided into three pulse emission intervals, or T1, T2, and T3. In the interval T1, a first middle dot ejection driving pulse DPM1 is emitted; in the interval T2, a second middle dot ejection driving pulse DPM2 is emitted; and in the interval T3, the cut driving pulse DPC is emitted. As a result, an amount of ink corresponding to a middle dot is ejected twice in succession from the nozzle 32 during the recording cycle T, thereby forming a large dot. After the ink ejection caused by the second middle dot ejection driving pulse DPM 2, a cut driving pulse DPC in which the lengths of time t, a, b, and c have been optimized is supplied to the piezoelectric vibrator 20, making it possible to impart vibrations of a phase inverted relative to residual vibrations arising in the ink within the pressurizing chamber 35 due to the ejection of the ink by the ejection driving pulses DPM1 and DPM2 even if the period leading to the next recording cycle is short; this makes it possible to suppress the residual vibrations from imparting negative influence on the ejection operations of the next recording cycle.

Although a piezoelectric vibrator 20 in a so-called axially-vibrating mode was described in the above embodiments as an example of a pressurizing unit, the pressurizing unit is not limited thereto. For example, the invention may also be applied when using a piezoelectric vibrator in a so-called lateral vibration mode. Note, however, that when a piezoelectric vibrator in a lateral vibration mode is employed, the waveforms of the driving pulses illustrated in FIGS. 3A and 5 are inverted.

Finally, the invention is not limited to a printer, and may be applied in any liquid ejecting apparatus capable of using multiple driving signals to control the ejection, such as a plotter, a facsimile apparatus, a copy machine, or the like; various types of ink jet recording apparatuses; liquid ejecting apparatuses aside from recording apparatuses, such as, for example, display manufacturing apparatuses, electrode manufacturing apparatuses, chip manufacturing apparatuses; and so on.

Therefore, the invention is not limited to the above described embodiments and can be modified within the scope of the appended claims. Such modifications are also obviously contained within the range of the invention.

The entire disclosure of Japanese Patent Application No. 2009-072227, filed Mar. 24, 2009 is expressly incorporated by reference herein.

What is claimed is:

1. A liquid ejecting apparatus comprising:

a liquid ejecting head including a nozzle, a pressurizing chamber that communicates with the nozzle, and a pressurizing element that causes a pressure change in liquid within the pressurizing chamber, the liquid ejecting head being capable of ejecting liquid from the nozzle by operating the pressurizing element; and a driving signal generation unit that generates a driving signal including a driving pulse that drives the pressurizing element, wherein the driving signal includes an ejection driving pulse that ejects a liquid droplet and a non-ejection driving pulse that drives the pressurizing element to a degree whereby a liquid droplet is not ejected;

the ejection driving pulse is a pulse waveform having an expansion element that causes the pressurizing chamber to expand and retract a meniscus toward the pressurizing chamber and a constriction element that causes the pressurizing chamber expanded by the expansion element to constrict and push the meniscus in a direction of ejection;

the non-ejection driving pulse is a pulse waveform having an expansion element that causes the pressurizing chamber to expand and retract the meniscus toward the pressurizing chamber, a holding element that holds a voltage at an end of the expansion element for a set amount of time, and a constriction element that causes the pressurizing chamber expanded by the expansion element to constrict and push the meniscus in the direction of ejection; and when a length of time from an end of the constriction element in the ejection driving pulse to a beginning of the expansion element in the non-ejection driving pulse is taken as t, the lengths of time of the expansion element, holding element, and constriction element in the non-ejection driving pulse are taken as a, b, and c, respectively, and an inherent vibration cycle of the liquid within the pressurizing chamber is taken as Tc, t, a, b, and c are within ranges defined by the following equations (1) through (3):

$$Tc/4 \leqq t \leqq Tc/2 \quad (1)$$

$$(5Tc/8)-t \leqq a \leqq (3Tc/4)-t \quad (2)$$

$$b+c=Tc-t-a \quad (3).$$

2. The liquid ejecting apparatus according to claim 1, wherein voltage difference of the expansion element in the non-ejection driving pulse is set at less than or equal to 40% of potential difference between the minimum potential and the maximum potential of the ejection driving pulse.

3. A control method for a liquid ejecting apparatus that includes a liquid ejecting head having a nozzle, a pressurizing chamber that communicates with the nozzle, and a pressurizing element that causes a pressure change in liquid within the pressurizing chamber, the liquid ejecting head being capable of ejecting liquid from the nozzle by operating the pressurizing element, and a driving signal generation unit that generates a driving signal including a driving pulse that drives the pressurizing element, the method comprising:

an ejection driving process of ejecting a liquid droplet and a non-ejection driving process of driving the pressurizing element to a degree whereby a liquid droplet is not ejected, wherein the ejection driving process includes an expansion process of causing the pressurizing chamber to expand and retract a meniscus toward the pressurizing chamber and a constriction process of causing the pressurizing chamber to constrict and push the meniscus in a direction of ejection;

the non-ejection driving process includes an expansion process of causing the pressurizing chamber to expand and retract the meniscus toward the pressurizing chamber, an expansion holding process of holding a state of expansion of the pressurizing chamber in the expansion process for a set amount of time, and a constriction process of causing the pressurizing chamber to constrict and push the meniscus in the direction of ejection; and when a length of time from an end of the constriction process in the ejection driving process to a beginning of the expansion process in the non-ejection driving process is taken as t, the lengths of time of the expansion process, expansion holding process, and constriction process in the non-ejection driving process are taken as a, b, and c, respectively, and an inherent vibration cycle of the liquid within the pressurizing chamber is taken as Tc, t, a, b, and c are within ranges defined by the following equations (1) through (3):

$$Tc/4 \leqq t \leqq Tc/2 \quad (1)$$

$$(5Tc/8)-t \leqq a \leqq (3Tc/4)-t \quad (2)$$

$$b+c=Tc-t-a \quad (3).$$

* * * * *